US011295916B2

(12) United States Patent
Guignot et al.

(10) Patent No.: US 11,295,916 B2
(45) Date of Patent: Apr. 5, 2022

(54) STARTER CONTACTOR COMPRISING A SEALING DEVICE AND STARTER COMPRISING SUCH A CONTACTOR

(71) Applicant: Valeo Equipements Electriques Moteur, Creteil (FR)

(72) Inventors: Romain Guignot, Isle d'Abeau (FR); Nicolas Renard, Saint Quentin Fallavier (FR); Jean Sébastien Metral, Isle d'Abeau (FR); Cyril Bouillard, Saint Quentin Fallavier (FR)

(73) Assignee: Valeo Equipements Electriques Moteur, Creteil (FR)

( * ) Notice: Subject to any disclaimer, the term of this patent is extended or adjusted under 35 U.S.C. 154(b) by 191 days.

(21) Appl. No.: 16/612,180

(22) PCT Filed: May 4, 2018

(86) PCT No.: PCT/EP2018/061619

§ 371 (c)(1),
(2) Date: Nov. 8, 2019

(87) PCT Pub. No.: WO2018/206469

PCT Pub. Date: Nov. 15, 2018

(65) Prior Publication Data

US 2021/0134549 A1 May 6, 2021

(30) Foreign Application Priority Data

May 12, 2017 (FR) ..... 1754159

(51) Int. Cl.
*H01H 50/02* (2006.01)
*H01H 51/06* (2006.01)
(Continued)

(52) U.S. Cl.
CPC ..... *H01H 50/023* (2013.01); *H01H 51/065* (2013.01); *F02N 11/087* (2013.01);
(Continued)

(58) Field of Classification Search
CPC .. H01H 50/023; H01H 50/026; H01H 51/065; H01H 50/14; H01H 50/20; F02N 11/087; F02N 2011/0874
See application file for complete search history.

(56) References Cited

U.S. PATENT DOCUMENTS 5,973,581 A * 10/1999 Jacquin ..... H01H 51/065 335/126
6,229,416 B1 * 5/2001 Ebihara ..... H01H 51/065 335/127
(Continued)

FOREIGN PATENT DOCUMENTS

| | | | |
|---|---|---|---|
| CN | 103619698 | A | 3/2014 |
| CN | 106328443 | A | 1/2017 |
| DE | 19631448 | A1 | 2/1997 |
| EP | 0789379 | A1 | 8/1997 |
| EP | 2151845 | A2 | 2/2010 |

(Continued)

OTHER PUBLICATIONS

International Search Report and Written Opinion corresponding to International Application No. PCT/EP2018/061619, dated Jul. 13, 2018 (13 pages).

(Continued)

*Primary Examiner* — Bernard Rojas
(74) *Attorney, Agent, or Firm* — Osha Bergman Watanabe & Burton

(57) ABSTRACT

A starter switch (2) comprises a housing (3) extending along an axis (X) that delimits at least one interior space (4), at least one coil (5) housed in said interior space (4), at least one fixed core (10) passed through by a shaft (6) that is movable in translation along the direction of the axis (X) and at least one cavity (12) comprising an electrical connection area, said cavity being separated from the interior space (4) by the fixed core (10). The starter (1) switch (2) comprises at least one sealing device (22) providing a seal between the interior space (4) of the starter (1) switch (2) and the cavity (12) comprising the connection area.

12 Claims, 4 Drawing Sheets

(51) Int. Cl.
*F02N 11/08* (2006.01)
*H01H 50/14* (2006.01)
*H01H 50/20* (2006.01)

(52) U.S. Cl.
CPC ..... *F02N 2011/0874* (2013.01); *H01H 50/14* (2013.01); *H01H 50/20* (2013.01)

(56) References Cited

U.S. PATENT DOCUMENTS

| | | | | |
|---|---|---|---|---|
| 7,973,624 | B2 * | 7/2011 | Kramer | H01H 50/023 335/126 |
| 9,812,274 | B2 * | 11/2017 | Haehnel | H01H 50/023 |
| 10,164,496 | B2 * | 12/2018 | Biessenberger | F02N 11/0851 |
| 2010/0330850 | A1 | 12/2010 | Niimi | |
| 2014/0176267 | A1 | 6/2014 | Hirabayashi | |

FOREIGN PATENT DOCUMENTS

| | | | |
|---|---|---|---|
| EP | 2442332 | A1 | 4/2012 |
| EP | 2461338 | A1 | 6/2012 |
| FR | 2045092 | A5 | 2/1971 |
| FR | 2740604 | A1 | 4/1997 |
| FR | 2768259 | A1 | 3/1999 |

OTHER PUBLICATIONS

The First Office Action in corresponding Chinese Application No. 201880039153.3, dated May 7, 2021 (11 pages).

* cited by examiner

STARTER CONTACTOR COMPRISING A SEALING DEVICE AND STARTER COMPRISING SUCH A CONTACTOR

The field of the present invention is that of starters for thermal engines for motor vehicles.

According to a known design, a contactor of a starter of a thermal engine, in particular of a motor vehicle, comprises a cylindrical housing in which there is placed an annular coil which generates a magnetic field under the effect of an electrical current which passes through it. According to the polarisation of the coil, the magnetic field thus created exerts a force on a mobile core which is cylindrical and at least partly magnetic. The mobile core is fitted in an interior space which is delimited by the cylindrical housing, such as to be able to slide there according to axial translation, driving with it a mobile shaft, in order to close or open an electrical circuit which is connected to a supply circuit of the electric motor of the starter. This opening/closure of the electrical circuit is carried out in an area of connection contained in a cavity in the contactor, this cavity being separated form the interior space by a fixed core.

A disadvantage of these contactors consists in the vulnerability of their components when faced with the aggressions of the exterior environment, and particularly when faced with humidity. Thus, the water or sprayed water which manages to penetrate into the contactor can give rise to an electrical contact between one of the electrical terminals arranged in the cavity comprising the area of connection and the housing of the contactor. This electrical contact can then create a short-circuit of the battery to which this electrical terminal is connected electrically, this short-circuit being able to give rise to a thermal incident.

This disadvantage is all the more significant for starter contactors used in humid geographical areas which can have damaged road infrastructures, as well as for starter contactors of off-road vehicles which can be used regularly in rough and in particular humid environments. In order to improve the operation of these contactors, it is already known to put into place devices for sealing between the starter contactor and the environment on the exterior of this contactor.

It is thus known to place sealing devices between the area of connection and the environment on the exterior of the contactor, in order to ensure sealing between this exterior environment and the starter contactor.

However, the movements of translation of the mobile core generate a piston effect when the core emerges from the housing, giving rise to aspiration of the air from the exterior and interior environment of the starter contactor, and thus at the same time dust and water present in this air. This dust and water can therefore penetrate into the interior space of the contactor, and, during subsequent activation of the contactor, can reach the cavity which contains the area of connection. The water can then migrate and reach the area of connection, and finally give rise to the same difficulties as those described above. The sealing devices which are put into place at present are therefore not sufficient.

The present invention comes within this context, and its objective is to propose a device which makes it possible to ensure sealing between the interior space of the contactor and the cavity of this contactor which contains the area of connection.

The subject of the invention is thus a starter contactor comprising a housing which extends along an axis, and delimits at least one interior space, at least one coil accommodated in this interior space, at least one fixed core through which there passes a shaft which is mobile in translation in the direction of the axis, and at least one cavity comprising an area of electrical connection, the said cavity being separated from the interior space by the fixed core. This starter contactor comprises at least one sealing device which ensures sealing between the interior space of the starter contactor and the cavity comprising the area of connection.

This sealing device which ensures the sealing between the interior space of the starter contactor and the cavity comprising the area of connection is known hereinafter as the "first sealing device".

The assembly of the elements of the contactor is thus contained in the housing, this housing being closed by a cover with at least two orifices through which at least two electrical terminals pass.

This contactor can have at least one second sealing device which ensures sealing between an electrical terminal of the area of connection and the cover which closes the housing. This second sealing device can for example be placed around the electrical terminal, at the orifice by means of which this electrical terminal passes through the cover.

Advantageously, the contactor can have two sealing devices, placed respectively on the periphery of each of the two electrical terminals, at each of the orifices by means of which these electrical terminals pass through the cover.

Optionally, this contactor can also comprise a third sealing device ensuring sealing between the housing of the contactor and the cover. This third sealing device can for example be placed on the periphery of the cover.

Optionally, this contactor can also comprise a fourth sealing device ensuring sealing between the interior space of the starter contactor and the cavity comprising the area of connection. This fourth sealing device can for example be placed between the fixed core and the housing.

According to a variant embodiment of the present invention, the second, third and fourth sealing devices can be O-ring seals.

According to another variant embodiment of the present invention, the second, third and fourth sealing devices can be form seals, which for example are rectangular or oblong.

According to a variant embodiment, the third and the fourth sealing devices are formed from a single sealing device which ensures sealing between the fixed core and the cover. This sealing device thus makes it possible to insulate the cavity comprising the area of connection both against the interior space and the exterior environment of the contactor. This sealing device can be an O-ring seal or a form seal, which for example is rectangular or oblong. This device can be accommodated in an axial recess in the cover, and it can be compressed against an axially normal flat surface of the fixed core. The axial depth of this recess is selected such as to retain the device in position when the contactor is not in the fitted state. In particular, the device is inserted in the recess by at least 50% of its axial length in the fitted state.

It is understood here that the cavity which contains the area of connection is thus completely sealed against the air which surrounds it, whether this area is on the exterior of the contactor, or present in the housing where the coil of the contactor extends.

According to one embodiment, the first sealing device can be placed in the cavity which contains the area of connection.

According to a first embodiment, the contactor has a receptacle for integration of the first sealing device, arranged on the fixed core.

According to a second embodiment of the present invention, the contactor has a receptacle for integration of the first sealing device, arranged on the mobile shaft.

According to the first embodiment of the present invention, the first sealing device is integral with the integration receptacle arranged in the fixed core, this first sealing device being in sliding contact with the mobile shaft. In this case, the first sealing device is fixed relative to the housing when the mobile shaft is translated.

According to the second embodiment of the present invention, the first sealing device is integral with the integration receptacle arranged in the mobile core, this first sealing device being in sliding contact with the fixed core. In this other case, the first sealing device is mobile at the same time as the mobile shaft, when the latter is translated in the fixed core.

According to an embodiment of the present invention, the first sealing device is retained in position in an integration receptacle by means of a support washer. This support washer can for example have a conical cross-section, seen on a cross-section formed on a plane which passes through its central axis.

The mobile shaft of the contactor according to the present invention can have at least one first stop against which the support washer is placed. The first stop can be integral with the mobile shaft. The fixed core of the contactor according to the present invention for its part can have at least one second stop against which the support washer is placed.

According to a characteristic of the present invention, the first sealing device is placed in the cavity which contains the area of connection.

According to an embodiment of the present invention, the first sealing device can be a lip seal.

According to another embodiment of the present invention, the first sealing device can be a self-lubricated seal.

According to another embodiment of the present invention, the first sealing device can be an O-ring seal.

According to another aspect of the invention, the sealing device which ensures the sealing between the interior space of the starter contactor and the cavity comprising the area of connection can comprise a seal and a sealing ring.

The sealing ring can be placed between the seal and the mobile shaft.

The seal can be an O-ring seal. The seal can be made of peroxidised EPDM, or from a material selected from amongst EPDM, NBR, FKM, ACM.

The sealing ring can be a dynamic sealing ring. The ring can be made of PTFE. In addition to the PTFE, the ring can comprise bronze and/or carbon (PTFE filled with bronze or PTFE filled with carbon). The sealing ring makes it possible to prevent the wear by exfoliation which is observed during a to-and-fro motion of the mobile shaft when a seal is directly in contact with the mobile shaft. The wear by exfoliation would make the system non-sealed over a period of time.

The sealing ring can have a cylindrical surface which is in sliding contact with the mobile shaft. Facing the mobile shaft, the ring can have a cavity which makes it possible to establish a pressure force of the seal on the mobile shaft which is different according to its direction of displacement.

According to another aspect of the invention, when the sealing device comprises the seal and the sealing ring as well as the support washer, the support washer can come into contact only with the sealing ring. The seal is not clamped axially in the receptacle of the fixed core. The support washer can have a flat surface facing the sealing device.

According to another aspect of the invention, the second stop against which the support washer abuts can be a notch in the fixed core. The second stop can be situated radially beyond the sealing device.

According to another aspect of the invention, the sealing ring can be thin or thick. According to the application, the ring is thin if its radial dimension is at least twice as small as that of the O-ring seal in the compressed state, i.e. in position in the contactor. It is thick if its radial dimension is substantially equal to that of the seal in the compressed state.

The sealing ring can comprise axial rims to retain the seal in position.

The present invention also relates to a starter of a thermal engine comprising at least one contactor according to the present invention.

Other characteristics, details and advantages of the present invention will become more clearly apparent from reading the detailed description provided hereinafter by way of indication, in relation with the different embodiments of the invention illustrated in the following figures.

Hereinafter in the description, the terms axial, radial, exterior and interior refer to an axis X which passes through the starter contactor according to the present invention in its centre. The axial direction corresponds to the axis X which passes through the centre of the mobile core, the fixed core, the mobile shaft, the housing and the coil, whereas the radial orientations correspond to planes perpendicular to the axis X. For the radial directions, the terms exterior or interior are understood relative to the same axis X, with the term interior corresponding to an element which is oriented towards the axis X, or closer to the axis X than a second element, and the term exterior designates radial spacing from this axis X.

Figure 1:
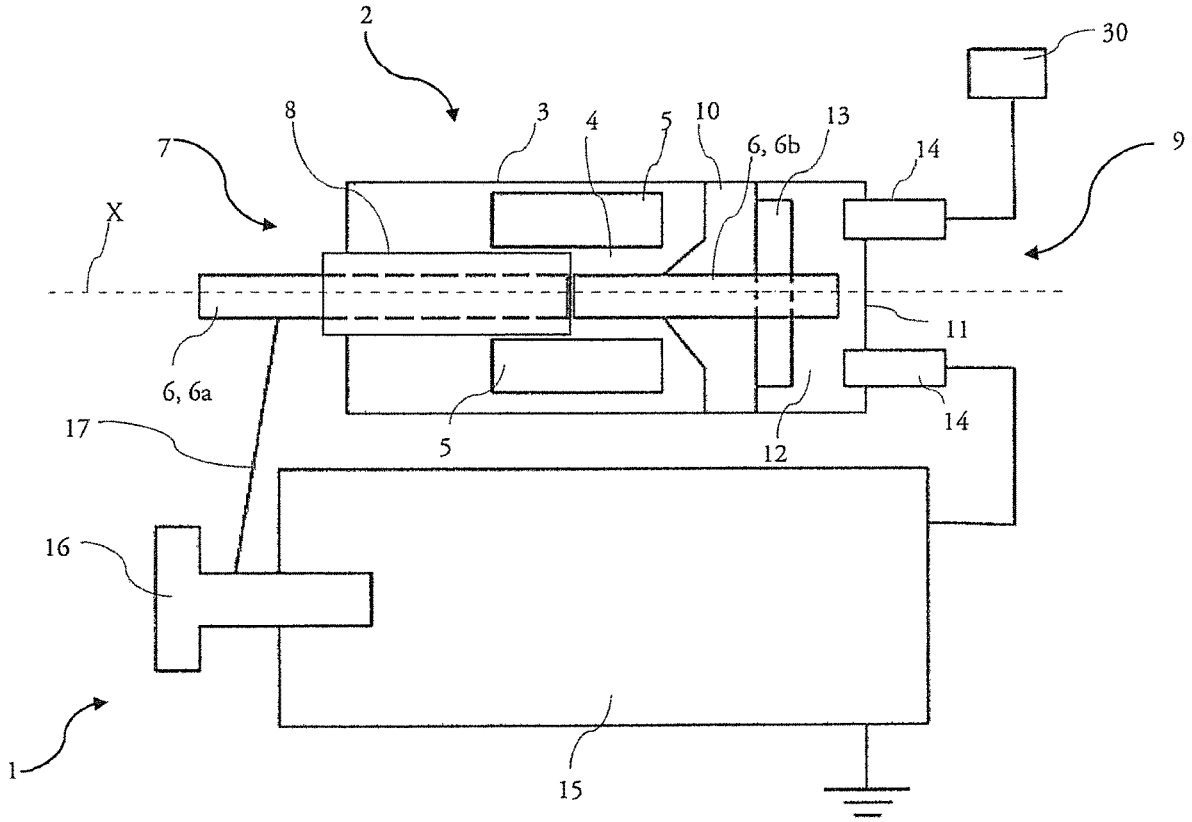
FIG. 1 is a schematic representation according to an axial cross-section of a starter comprising a contactor according to the present invention and an electric motor.

FIG. 1 represents schematically a starter 1 of a thermal engine of a motor vehicle comprising a contactor 2 according to the present invention.

The starter contactor 2 has a housing 3 which extends along an axis X and delimits an interior space 4, which for example has a cylindrical form, in which there is accommodated an annular coil 5 as well as a shaft 6 which is mobile in translation along the axis X.

The housing 3 has a first axial end 7 through which there passes a first section 6*a* of the mobile shaft 6 retained by a mobile core 8, and a second axial end 9 through which there passes a second section 6*b* of the mobile shaft 6, which for its part is retained by a fixed core 10. As illustrated in FIG.

1, the first section 6*a* of the mobile shaft 6 and the second section 6*b* of this mobile shaft 6 are in contact with one another.

The first axial end 7 has a whole, not represented here, through which the mobile core 8 can slide, driving with it the first section 6*a* of the mobile shaft 6, whereas the second axial end 9 is closed by a cover 11. Thus, the mobile shaft 6 passes through the centres of, and in this order: the fixed core 10, the mobile core 8 and the hole in the first axial end 7 of the housing 3.

The fixed core 10 can for example have the general form of a disc, and it is supported against an inner face of the housing 3, at a shoulder of this housing 3, and against the cover 11.

As illustrated in FIG. 1, the second axial end 9 has a cavity 12 which is delimited radially towards the exterior by the cover 11, and axially on one side by the fixed core 10, and on another side by the cover 11. This cavity 12 accommodates an area of electrical connection in which there extend at least one connection plate 13 and two electrical terminals 14. These terminals 14 extend on an inner face of the cover 11, and passes through it via two distinct orifices.

The starter 1 also comprises an electric motor 15, which is electrically connected to the contactor 2 via one of the terminals 14 of the contactor 2. This electric motor 15 also has a pinion 16 which is mobile in translation in a direction parallel to the axis X, a pinion of this type being designed to engage on an engine flywheel of the thermal engine.

A first electrical terminal 14 is connected to a battery 30 which supplies an electric current, for example with a voltage of 12 V or 24 V. A second electrical terminal 14 is for its part connected to the electric motor 15 of the starter. The electrical terminals 14 thus participate in a supply circuit of the starter 1, and, when the electrical connection plate 13 is brought into contact with the electrical terminals 14, the supply circuit of the starter 1 is closed, and the current can circulate, thus permitting starting of the thermal engine as described hereinafter. The coil 5 generates a magnetic field under the effect of an electric current passing through it. According to the polarisation of this coil 5, the magnetic field thus created exerts an attractive or repulsive force on the mobile core 8, which can thus slide according to axial translation in the housing 3. When this mobile core 8 penetrates into the housing 3, it exerts a translation force on the first section 6*a* of the mobile shaft 6, which in turn drives the second section 6*b* of the mobile shaft 6, such that the electrical connection plate 13 comes into contact with the electrical terminals 14. Once the electrical connection plate 13 is in contact with the terminals 14, the supply circuit of the electric motor 15 is closed.

The first section 6*a* of the mobile shaft 6 controls a fork 17, which makes it possible to put the pinion 16 of the electric motor 15 into position, on an engine flywheel not represented here. When the connection plate 13 is put into contact by the movement of translation of the mobile shaft 6, the supply circuit of the electric motor 15 is closed, which allows this electric motor 15 to operate, and thus to rotate the pinion 16. This rotation of the pinion 16 in turn makes it possible to launch the engine flywheel, and thus to start the thermal engine of the vehicle.

The mobile shaft 6 is described here with two sections 6*a* and 6*b*, but it is understood that this mobile shaft can be in a single piece from the fork 17 as far as the connection plate 13.

At least a first return spring, which for example is of the helical type, is designed to thrust back the second section 6*b* of the mobile shaft 6, which in turn and simultaneously thrusts the mobile core 8 and the first section 6*a*, when power is not being supplied to the coil 5.

When power is supplied to the coil 5, the mobile shaft 6, and more particularly its first section 6*a*, compresses the return spring by a movement of translation along the axis X as previously described. When the coil 5 is no longer supplied with power, this first return spring thrusts the mobile core 8 back out of the interior space 4, so that the mobile core regains its original position. Thus, the first section 6*a* of the mobile shaft 6 can regain its original position, as can the second section 6*b* of this mobile shaft 6, which is also thrust back by a second return spring represented in FIGS. 2 to 4.

By regaining its position, the first section 6*a* of the mobile shaft 6 drives the pinion 16 of the electric motor 15 via the fork 17, this pinion 16 thus being disengaged from the engine flywheel.

In addition, by regaining its initial position, the second section 6*b* of the mobile shaft 6 drives the electrical connection plate 13. This electrical connection plate 13 is then no longer in contact with the electrical terminals 14, and the supply circuit of the electric motor 15 is thus open, which prevents the circulation of the electric current, and gives rise to stoppage of this electric motor 15.

It will be noted that the fixed core 10 forms a translation bearing relative to the mobile shall 6, in particular its second section 6*b*. In fact, the fixed core 10 is pierced by a hole in its centre, which hole allows the mobile shaft 6 to slide. This hole forms a passage between the interior space 4 and the cavity 12.

Figure 2:
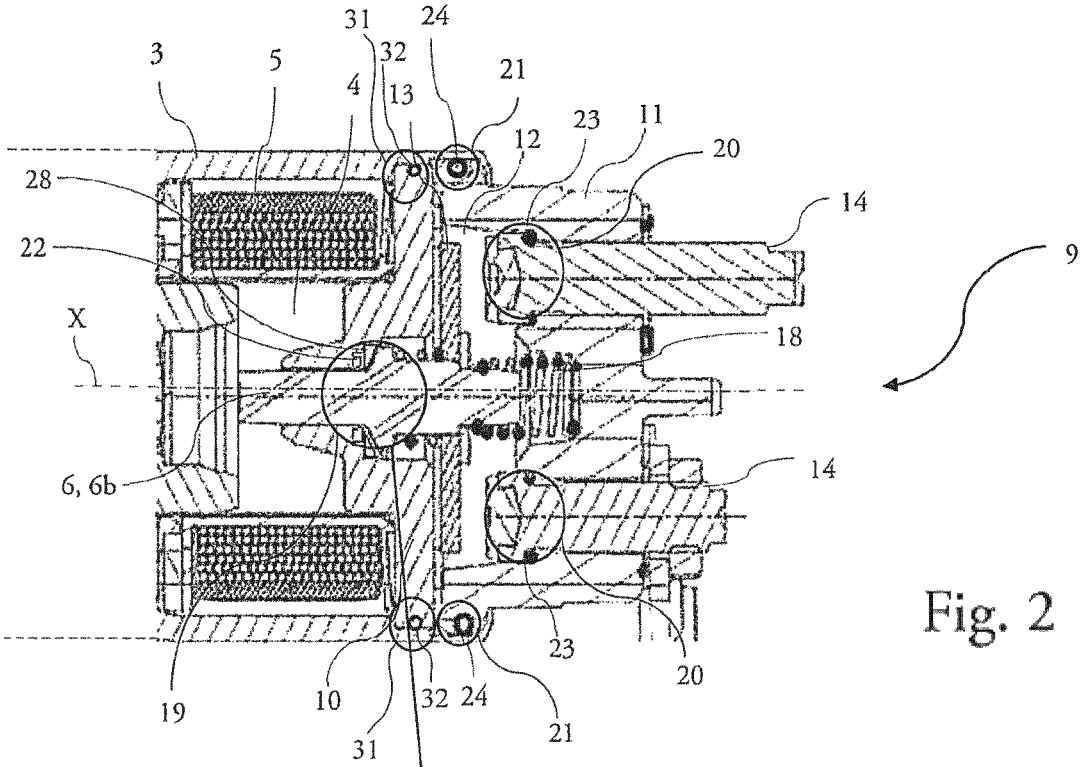
FIG. 2 is a view according to an axial cross-section of a part of a starter contactor according to the present invention.

FIG. 2 is a view according to an axial cross-section of a part of the contactor 2, at the second axial end 9 of this contactor 2. This figure represents in particular the cavity 12 with the area of connection and the interior space 4 of the starter contactor 2. This FIG. 2 also shows the fixed core 10, the mobile shaft 6, and more particularly the second section 6*b* of this mobile shaft 6, as well as the housing 3 in which the coil 5 is accommodated. As previously described, this housing 2 is closed axially by the cover 11, in which there are provided two orifices through which each of the electrical terminals 14 pass respectively. This figure also illustrates the second return spring 18, which allows the mobile shaft 6, and in particular the second section 6*b* of this mobile shaft 6, to regain its initial position as previously described.

The contactor 2 has a plurality of areas of sealing 19, 20, 21, 31. A first area of sealing 19 is provided between the interior space 4 and the cavity 12 which has the area of electrical connection. A second area of sealing 20 and a third area of sealing 21 are for their part provided between an environment on the exterior of the contactor 2 and the cavity 12 with the area of electrical connection. A fourth area of sealing 31 is provided between the interior space 4 and the cavity 12 with the area of electrical connection, in a location different from the first area of sealing 19. It is thus understood that the first area of sealing 19 and the fourth area of sealing 31 are formed between spaces inside the contactor according to the invention, whereas the second area of sealing 20 and the third area of sealing 21 are formed between the environment on the exterior of the contactor and a space inside the contactor, in this case the cavity 12.

Thus, the areas of sealing at this cavity 12 make it possible to improve the service life of the starter contactor.

Figure 3:
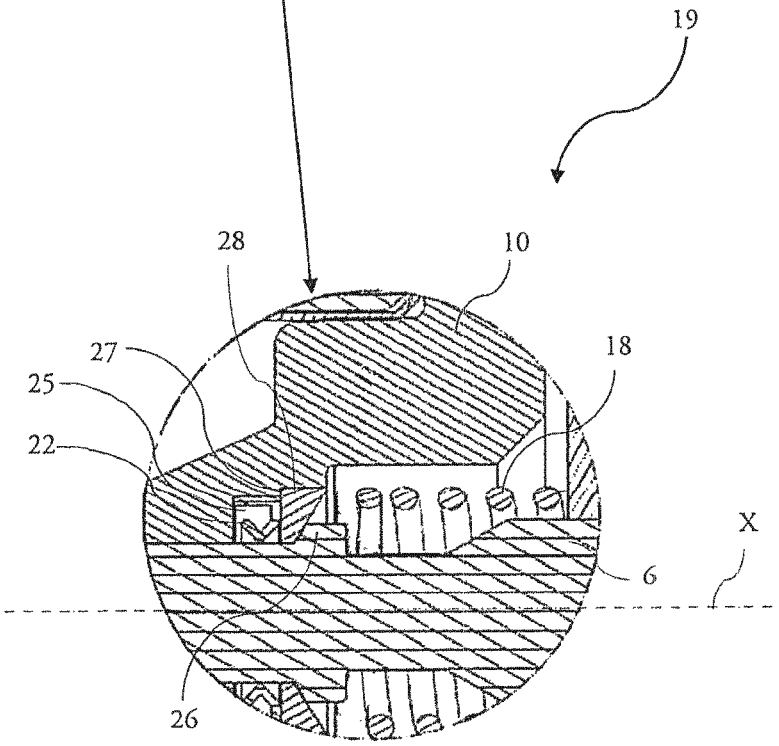
FIG. 3 is an enlargement of a first area of sealing of the contactor according to the present invention illustrated in FIG. 2.

The first area of sealing 19 is thus formed at the junction between the mobile shaft 6 and the fixed core 10, as represented in FIG. 3.

This first area of sealing 19 has a first sealing device 22 placed between the second section 6*b* of the mobile shaft 6 and the fixed core 10, and makes it possible to ensure sealing between the cavity 12, which contains the area of electrical connection, and the interior space 4. In addition, the first sealing device 22 makes it possible to ensure continuous insulation between the cavity 12 and the interior space 4, i.e. these two areas are sealed against one another irrespective of the position of the mobile shaft 6.

Preferably, the first sealing device 22 is placed in the cavity 12 which accommodates the area of electrical connection. In other words, this first sealing device 22 is placed between the second section 6*b* of the mobile shaft 6 and the fixed core 10 on the cavity 12 side, and not on the interior space 4 side. This position of the first sealing device 22 makes it possible not to affect the force of attraction or repulsion exerted on the mobile core 8 by the coil 5. In fact, a form which would be arranged in the fixed core 10 on the interior space 4 side in order to receive a sealing device could disrupt the magnetic field generated by the coil 5 which loops back via the fixed core 10.

The first sealing device 22 according to the invention must be selected in order to make it possible to ensure sealing between two parts which are in translation relative to one another, in this case between the mobile shaft 6 and the fixed core 10 of the contactor. According to an embodiment of the present invention represented here, the first sealing device 22 can thus be a lip seal for example.

The second area of sealing 20 is provided at least between one of the electrical terminals 14 and the cover 11 of the housing 3, advantageously between each of the electrical terminals 14 and the cover 11 of the housing 3.

Thus, in FIG. 2, there are represented two second areas of sealing 20, each comprising a second sealing device 23 placed between one of the electrical terminals 14 and the cover 11 of the housing 3 of the contactor 2, at each of the orifices in the cover 11 through which these electrical terminals 14 pass.

These second sealing devices 23 are formed for example by O-ring seals which extend around the entire periphery of each of the electrical terminals 14, or, according to a variant embodiment, by form seals which for example are rectangular or oblong.

The third area of sealing 21 for its part comprises a third sealing device 24 placed at a junction between the housing 3 and the cover 11 of this housing 3. According to a variant of the invention, this third sealing device 24 can also be formed by a form seal, which for example is rectangular or oblong, extending around the entire periphery of the cover 11.

These second and third sealing devices 20, 21 thus make it possible to ensure sealing between the environment on the exterior of the contactor 2 and the cavity 12 in the contactor 2.

The fourth area of sealing 31 for its part comprises a fourth sealing device 32 placed at a junction between the housing 3 and the fixed core 10. This fourth sealing device 32 can be formed by an O-ring seal, or, according to a variant of the invention, by a form seal, which for example is rectangular or oblong, extending around the entire periphery of the fixed core 10.

Figure 5:
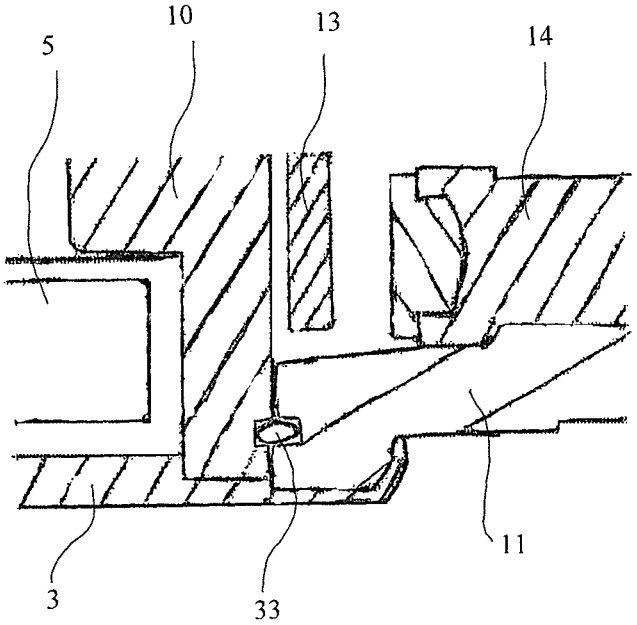
FIG. 5 is a schematic view according to an axial cross-section of the fourth area of sealing of the contactor according to the present invention illustrated in FIG. 2.

According to a variant embodiment represented in FIG. 5, the third sealing device 24 and the fourth sealing device 32 can be combined in a single sealing device 33 placed between the fixed core 10 and the cover 11. This sealing device 33 thus makes it possible to insulate the cavity 12 comprising the area of connection against both the interior space and the exterior environment of the contactor. This sealing device 33 can be formed by an O-ring seal, or, according to a variant of the invention, by a form seal, which for example is rectangular or oblong, extending on an inner face of the cover 11.

FIG. 3 illustrates a first embodiment of the first area of sealing 19. It can be seen that this first area of sealing 19 comprises the first sealing device 22.

As illustrated in FIG. 3, a receptacle 25 for integration of the first sealing device 22 is arranged on the fixed core 10. This first sealing device 22 is for example formed by a lip seal.

According to the present invention, this integration receptacle 25 is formed in an inner wall of the fixed core 10, i.e. a wall of this fixed core 10 which faces towards the mobile shaft 6. The lip seal(s) is/are rendered integral with this integration receptacle 25, as illustrated in FIG. 3, and the lip(s) is/are in sliding contact against the mobile shaft 6, thus ensuring the sealing, whilst permitting the movement of axial translation of this mobile shaft 6 relative to the fixed core 10.

According to another embodiment of the present invention not represented here, this first sealing device can be formed by a self-lubricated seal.

The mobile shaft 6 and the fixed core 10 can also have respectively a first and a second stop 26, 27. These two stops 26, 27 are formed in opposite directions to one another, and are configured such as to have interposed a support washer 28 which is supported on the first sealing device 22, thus ensuring the retention of this first sealing device 22 in the integration receptacle 25 arranged in the fixed core 10.

This washer 28 is an added-on part, which thus permits the fitting of the first sealing device 22 in the integration receptacle 25, with this part also blocking the first sealing device 22 so that it does not move during the translation of the mobile shaft 6. The washer 28 also particularly blocks the lip of the lip seal which forms an embodiment of the first sealing device 22.

Irrespective of the form of this support washer 28, the first and second stops 26, 27 have slopes which are complementary to the form of the support washer 28.

According to the first embodiment of the present invention illustrated in FIG. 3, this support washer 28 can have a conical cross-section, seen in a cross-section formed according to a plane which passes via its central axis. When the support washer 28 has a conical form, the first and second stops 26, 27 have conical slopes.

Figure 4:
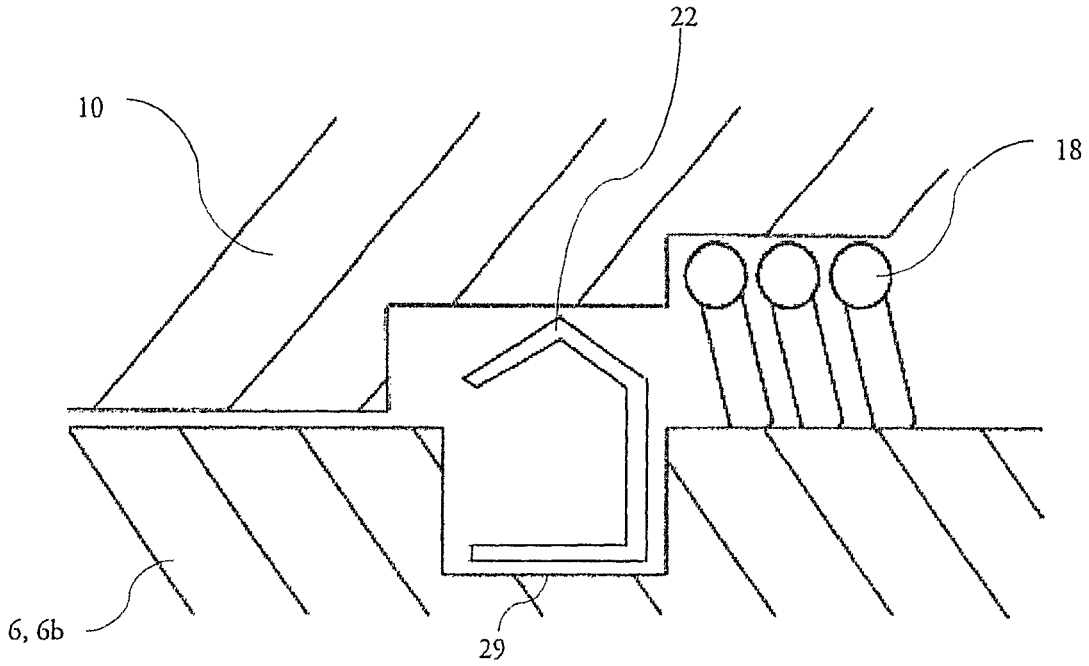
FIG. 4 is a schematic view according to an axial cross-section of the first area of sealing of the contactor according to a second embodiment of the present invention.

FIG. 4 illustrates schematically a second embodiment of the present invention. According to this second embodiment, a receptacle 29 for integration of the first sealing device 22 is arranged on the mobile shaft 6, in particular on its outer peripheral wall.

According to this second embodiment, the first sealing device 22 is also a lip seal. This lip seal is thus accommodated in the integration receptacle 29 arranged on the mobile shaft 6, and placed such that its lip rubs on the fixed core 10, thus ensuring the sealing despite the movement of translation of this mobile shaft 6 relative to the fixed core 10.

Although not represented in this FIG. 4, this second embodiment can also include the addition of a support washer making it possible to ensure efficient retention of the first sealing device 22. As for the first embodiment, the mobile shaft and the fixed core then have respectively the first and the second stop with forms complementary to that of the support washer, as previously described.

Figure 6:
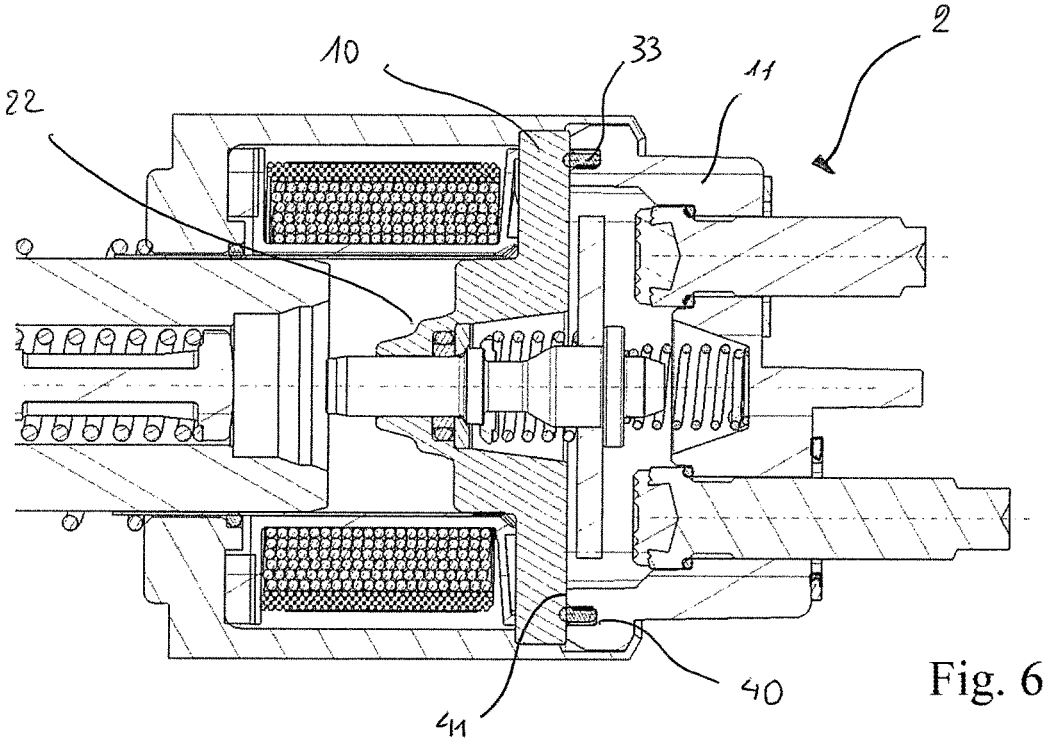
FIG. 6 is a view according to an axial cross-section of a part of another example of a starter contactor according to the present invention.
Figure 7:
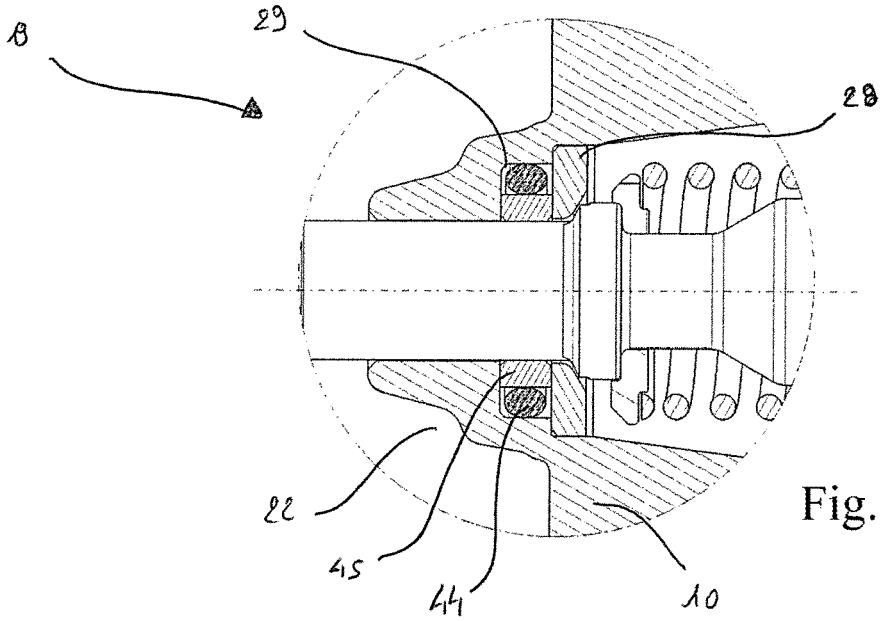
FIG. 7 is an enlargement of a first area of sealing of the contactor according to the present invention illustrated in FIG. 6.

FIGS. 6 and 7 illustrate another example of a starter contactor 2 according to the present invention.

The example in FIG. 6 differs from the example in FIG. 2, in particular at the third and fourth sealing devices and in the form of the sealing device 22.

In the example concerned, in the manner of FIG. 5, the contactor 2 comprises a single sealing device 33, which forms the third and fourth sealing devices in order to ensure sealing between the fixed core 10 and the cover 11.

In the example concerned, the sealing device 33 is accommodated in an axial recess 40 in the cover 11, and is compressed against an axially normal flat surface 41 of the fixed core. In this case, the sealing device 33 is a seal with an oblong cross-section, but it can also be formed as a form seal, which for example is rectangular or annular.

In the example concerned, and with reference to FIG. 7, the sealing device 22 which ensures the sealing between the interior space of the starter contactor and the cavity comprising the area of connection comprises a seal 44 and a sealing ring 45. The sealing ring 45 is in this case a dynamic sealing ring placed between the seal 44 and the mobile shaft 6. The seal can be an O-ring seal in the free state.

The sealing ring can have a cylindrical surface in sliding contact with the mobile shaft 6.

In the example concerned, the sealing device 22 is integral with the integration receptacle 29 arranged in the fixed core, and the sealing device is retained in this receptacle by a support washer 28. In this case, the support washer 28 comes into contact only with the sealing ring 45. The seal 44 is not clamped axially in the receptacle 29 of the fixed core. The support washer 28 has a flat surface facing the sealing device 22. The contact is flat between the support washer 28 and the sealing ring 45.

The support washer 28 is integral with the fixed core 10, and the washer is for example crimped on the fixed core. The support washer does not rub on the mobile shaft 6.

Figure 8:
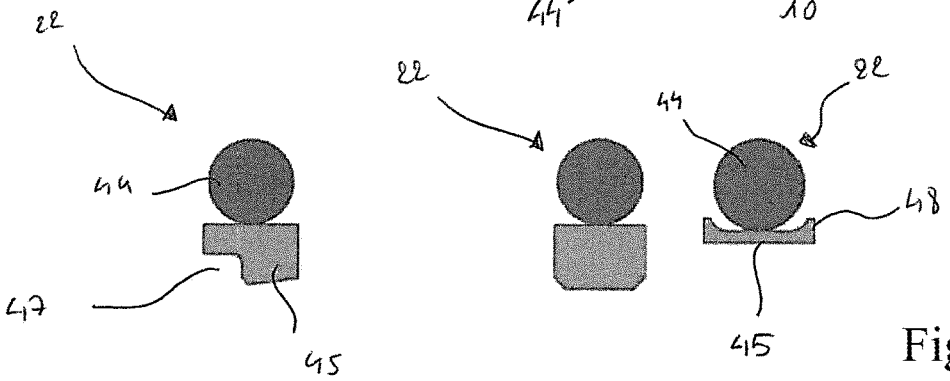
FIG. 8 represents different variants of a sealing device of the contactor in FIGS. 6 and 7.

Finally, FIG. 8 shows two variants of the sealing device 22 shown with reference to FIGS. 6 and 7 and which corresponds to the figure in the middle. The devices are shown in the free state, i.e. non-compressed.

In the first variant, the sealing ring 45 has a cavity 47 facing the mobile shaft 6, making it possible to establish a pressure force of the seal 44 on the mobile shaft which is different according to its direction of displacement.

In the third variant, the sealing ring 45 is thin. Its radial dimension is at least two times smaller than that of the O-ring seal in the compressed state, i.e. in position in the contactor. In the second variant, i.e. that of FIGS. 6 and 7, the sealing ring 45 is thick. Its radial dimension is substantially equal to that of the seal 44 in the compressed state.

In the third variant, the sealing ring 45 comprises axial rims 48 for the retention in position of the seal 44.

Thus, thanks to a sealing device which is placed between the mobile shaft and the fixed core, the invention makes it possible to ensure the sealing between the interior space of a contactor and the cavity of this contactor which has the area of electrical connection. This area of electrical connection is thus protected against dust and water which could penetrate into this cavity. Since this area of connection is protected, the service life of the starter contactor according to the present invention is improved.

However, the invention is not limited to the means and configurations described and illustrated here, and it also extends to all equivalent means or configurations and to any technical combination which uses these means. In particular, the sealing devices and the areas of sealing at which they are placed can be modified without detracting from the invention, provided that they fulfil the same functionalities as those described in this document.

The invention claimed is:

1. A starter contactor comprising:

a housing which extends along an axis, and delimits at least one interior space;

at least one coil accommodated in the interior space;

at least one fixed core through which there passes a shaft which is mobile in translation in the direction of the axis;

at least one cavity comprising an area of electrical connection, the cavity being separated from the interior space by the fixed core, at least one sealing device which ensures sealing between the interior space of the starter contactor and the at least one cavity comprising the area of electrical connection; and a receptacle for integration of the at least one sealing device which ensures the sealing between the interior space of the starter contactor and the at least one cavity comprising the area of electrical connection is arranged on the fixed core, wherein the at least one sealing device is retained in position in the receptacle for integration by a support washer.

2. The contactor according to claim 1, wherein the receptacle for integration of the at least one sealing device is arranged on the shaft which is mobile.

3. The contactor according to claim 2, wherein the at least one sealing device is integral with the integration receptacle arranged in the shaft which is mobile, this sealing device being in sliding contact with the fixed core.

4. The contactor according to claim 1, wherein the at least one sealing device is integral with the integration receptacle arranged in the fixed core, this sealing device being in sliding contact with the shaft which is mobile.

5. The contactor according to claim 1, wherein the mobile shaft has at least a first stop against which the support washer is placed.

6. The contactor according to claim 1, wherein the at least one sealing device is placed in the cavity which contains the area of electrical connection.

7. The contactor according to claim 1, wherein the at least one sealing device is a lip seal.

8. The contactor according to claim 1, wherein the at least one sealing device is a self-lubricated seal.

9. The contactor according to claim 1, wherein the at least one sealing device comprises a seal and a sealing ring.

10. The contactor according to claim 9, wherein the sealing ring is placed between the seal and the fixed core.

11. The contactor according to claim 10, wherein the support washer comes into contact only with the sealing ring.

12. A starter for a thermal engine comprising at least one contactor according to claim 1.

* * * * *